US007233195B2

(12) United States Patent
Oh

(10) Patent No.: US 7,233,195 B2
(45) Date of Patent: Jun. 19, 2007

(54) GENERATOR FOR SUPPLYING REFERENCE VOLTAGE AND REFERENCE CURRENT OF STABLE LEVEL REGARDLESS OF TEMPERATURE VARIATION

(75) Inventor: Hack-Soo Oh, Chungcheongbuk-do (KR)

(73) Assignee: Magnachip Semiconductor, Ltd. (KR)

( * ) Notice: Subject to any disclaimer, the term of this patent is extended or adjusted under 35 U.S.C. 154(b) by 32 days.

(21) Appl. No.: 11/123,639

(22) Filed: May 6, 2005

(65) Prior Publication Data

US 2005/0264346 A1 Dec. 1, 2005

(30) Foreign Application Priority Data

May 6, 2004 (KR) ..... 10-2004-0031946

(51) Int. Cl.
*G05F 1/10* (2006.01)

(52) U.S. Cl. ..... 327/538; 327/540

(58) Field of Classification Search ..... 327/538–540
See application file for complete search history.

(56) References Cited

U.S. PATENT DOCUMENTS 5,430,395 A * 7/1995 Ichimaru ..... 327/312
5,631,600 A * 5/1997 Akioka et al. ..... 327/543
5,880,625 A * 3/1999 Park et al. ..... 327/543
5,910,749 A * 6/1999 Kimura ..... 327/541
6,107,868 A * 8/2000 Diniz et al. ..... 327/543
6,111,396 A * 8/2000 Lin et al. ..... 323/313
6,191,646 B1 * 2/2001 Shin ..... 327/543
6,522,117 B1 * 2/2003 Young et al. ..... 323/315
6,528,979 B2 * 3/2003 Kimura ..... 323/313
6,870,418 B1 * 3/2005 Tang et al. ..... 327/513

FOREIGN PATENT DOCUMENTS

KR 1020000003050 1/2000
KR 1020040004023 1/2004

* cited by examiner

*Primary Examiner*—Timothy P. Callahan
*Assistant Examiner*—Hai L. Nguyen
(74) *Attorney, Agent, or Firm*—Blakely Sokoloff Taylor & Zafman

(57) ABSTRACT

A reference voltage and reference current generator supplies a reference voltage and a reference current, both having stable levels regardless of temperature variation. The reference voltage and reference current generator includes a reference voltage generating unit, a first current mirror, a temperature compensation MOS transistor and a second current mirror. The reference voltage generating unit outputs a reference voltage having a stable level regardless of temperature variation and process variation by using junction voltage characteristic and thermal voltage characteristic of a bipolar transistor, and supplies an inner current corresponding to the thermal voltage characteristic. The first current mirror supplies a first current by mirroring the inner current. The temperature compensation MOS transistor supplies a second current corresponding to the reference voltage through the source-drain stage. The second current mirror supplies a reference current corresponding to the sum of the first current and the second current.

4 Claims, 7 Drawing Sheets

GENERATOR FOR SUPPLYING REFERENCE VOLTAGE AND REFERENCE CURRENT OF STABLE LEVEL REGARDLESS OF TEMPERATURE VARIATION

FIELD OF INVENTION

The present invention relates to a semiconductor integrated circuit; and, more particularly, to a generator for supplying a semiconductor integrated circuit with a reference voltage and a reference current, both having stable levels regardless of temperature variation.

DESCRIPTION OF PRIOR ART

A semiconductor integrated circuit necessarily has a reference voltage of a stable level for internal operation. A reference voltage generator is to generate and output a reference voltage to the semiconductor integrated circuit.

FIG. 1 is a block diagram showing a conventional CMOS image sensor.

Particularly, in the CMOS image sensor 10, a correlated double sampling (CDS) 11 for saving a pixel signal and eliminating an offset, an auto gain control (AGC) 12 for amplifying an analog signal, an analog to digital converter (ADC) 13, and a phase locked loop (PLL) 14 for multiplying a frequency are necessary to input stable reference voltage and current for improving a quality of image from a band-gap reference voltage generator 15.

In the band-gap reference voltage generator 15, it is necessary to output the reference voltage of the stable level regardless of temperature variation or supply voltage variation.

FIG. 2 is a circuit diagram showing a conventional band-gap reference voltage generator.

Referring to FIG. 2, the conventional band-gap reference voltage generator includes bipolar transistors Q1, Q2, Q3, the collectors and the emitters of the respective transistors Q1, Q2, Q3 being commonly coupled to a ground voltage VSS, resistors R1, R2 coupled to the emitters of the transistors Q2, Q3, respectively, MOS transistors MP1, MP2, MP3, one ends of the respective MOS transistors MP1, MP2, MP3 being commonly coupled to a power supply voltage VDD and the other ends of the respective MOS transistors MP1, MP2, MP3 being coupled to the emitter of the bipolar transistor Q1, the resistors R1, R2, respectively, an operational amplifier 10 having a positive input (+) coupled to the emitter of the bipolar transistor Q1 and a negative input (−) coupled to the common input of the resistor R1 and the MOS transistor MP2, and a MOS transistor MP4 having one end coupled to the power supply voltage VDD, gate coupled to the output of the operational amplifier 10 and the other end for supplying a reference current Ibias.

FIG. 3 is a waveform diagram showing variation of a reference voltage due to temperature variation in a conventional reference voltage generator shown in FIG. 2. FIG. 4 is a waveform diagram showing variation of a reference current due to temperature variation in a conventional reference voltage generator shown in FIG. 2. It will be described for the operations of the conventional reference voltage generator and shortcomings thereof with reference to FIGS. 3 and 4.

First, the prescribed reference voltage generator supplies a reference voltage Vbg as follows.

$$Vbg=Vbe3+R2/R1\times V_T\times ln\ n \qquad \text{Eq. 1}$$

Here, since the reference voltage Vbg is an independent function on the power supply voltage VDD as shown in Eq. 1, the reference voltage generator generates a stable voltage without regard to the supplied power voltage.

Further, from relationship of the first term Vbe3 having negative characteristic of about −1.65 mV/° C. depending on temperature variation and the second term $V_T$ having positive characteristic of about +0.085 mV/° C. depending on temperature variation, the reference voltage can maintain a relatively stable level regardless of temperature variation.

As shown in FIG. 3, even if temperature varies in a range of −20° C. to 100° C., the level of the reference voltage changes just in a range of 1.1864 V to 1.1878 V.

On the other hand, the prescribed reference voltage generator also outputs the reference current Ibias, which can be represented as follows.

$$\text{Ibias}=I_{R1}=V_T\times ln\ n/R1 \qquad \text{Eq. 2}$$

As seen in Eq. 2, the reference current has a stable current without regard to the supplied power voltage.

However, contrary to the reference voltage, the reference current does not have a stable level under temperature variation but shows variation directly proportional to temperature variation, which comes from feature of $V_T$ in Eq. 2 that is directly proportional to temperature variation.

Accordingly, there is no problem in an analog system that only uses the reference voltage from the conventional reference voltage generator. However, in an analog system that uses the reference current as well as the reference voltage, the analog system can be affected by temperature characteristic because the reference current may increase depending on temperature variation.

Therefore, it is needed to develop a circuit capable of outputting a reference current having a stable level regardless of temperature variation.

SUMMARY OF INVENTION

It is, therefore, an object of the present invention to provide a reference voltage and reference current generator for supplying a reference voltage and a reference current, both having stable levels regardless of temperature variation.

In accordance with an aspect of the present invention, there is provided a reference voltage and reference current generator including a reference voltage generating unit for outputting a reference voltage having a stable level regardless of temperature variation and process variation by using junction voltage characteristic and thermal voltage characteristic of a bipolar transistor, and supplying an inner current corresponding to the thermal voltage characteristic; a first current mirror for mirroring the inner current to supply a first current; a temperature compensation MOS transistor for supplying a second current corresponding to the reference voltage through the source-drain stage; and a second current mirror for supplying a reference current corresponding to the sum of the first current and the second current.

BRIEF DESCRIPTION OF THE DRAWINGS

The above and other objects and features of the present invention will become apparent from the following description of preferred embodiments taken in conjunction with the accompanying drawings, in which.

DETAILED DESCRIPTION OF INVENTION

Hereinafter, a reference voltage and reference current generator in accordance with the present invention will be described in detail referring to the accompanying drawings.

Figure 1:
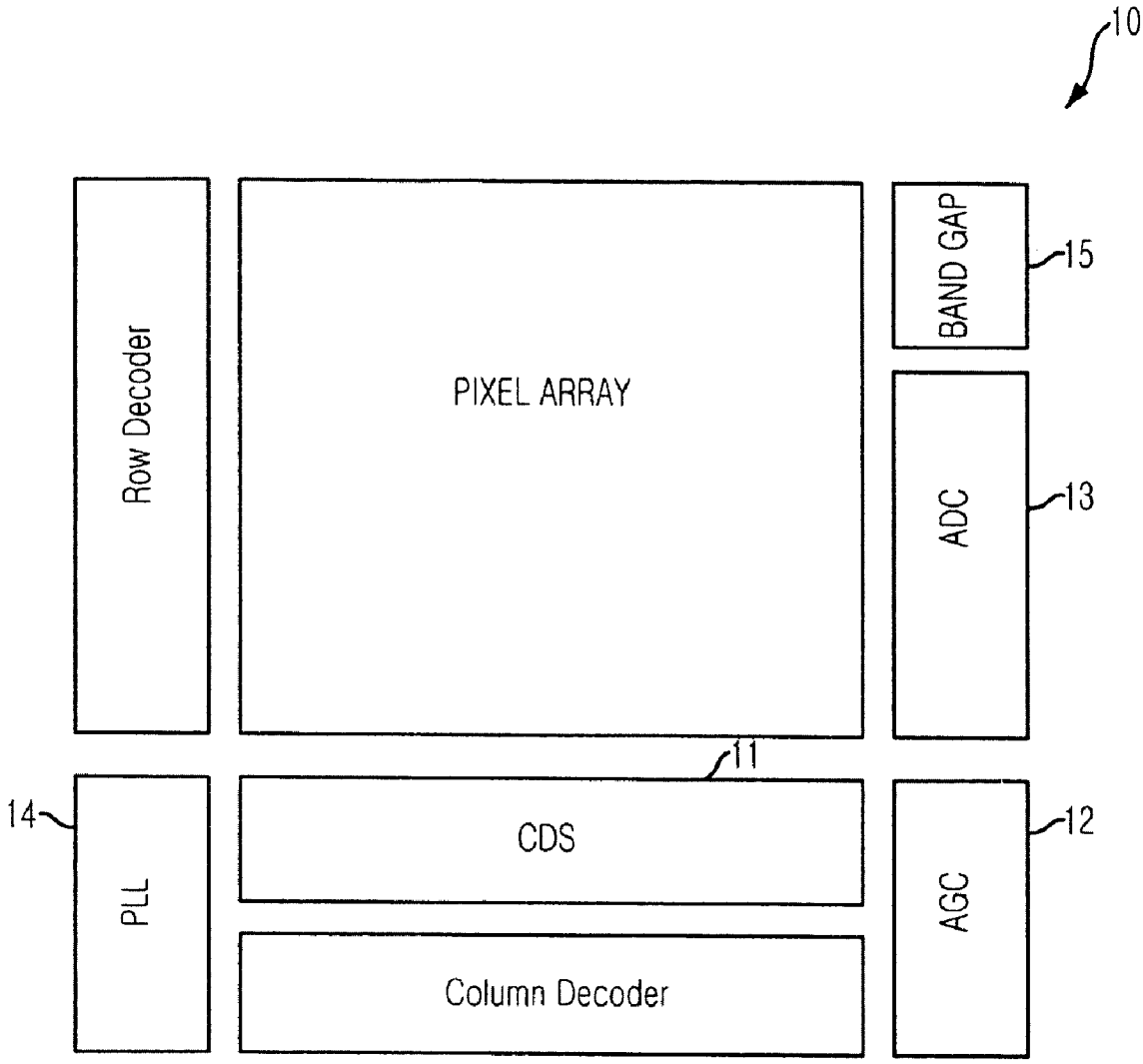
FIG. 1 (PRIOR ART)
FIG. 1 is a block diagram showing a conventional CMOS image sensor.
Figure 2:
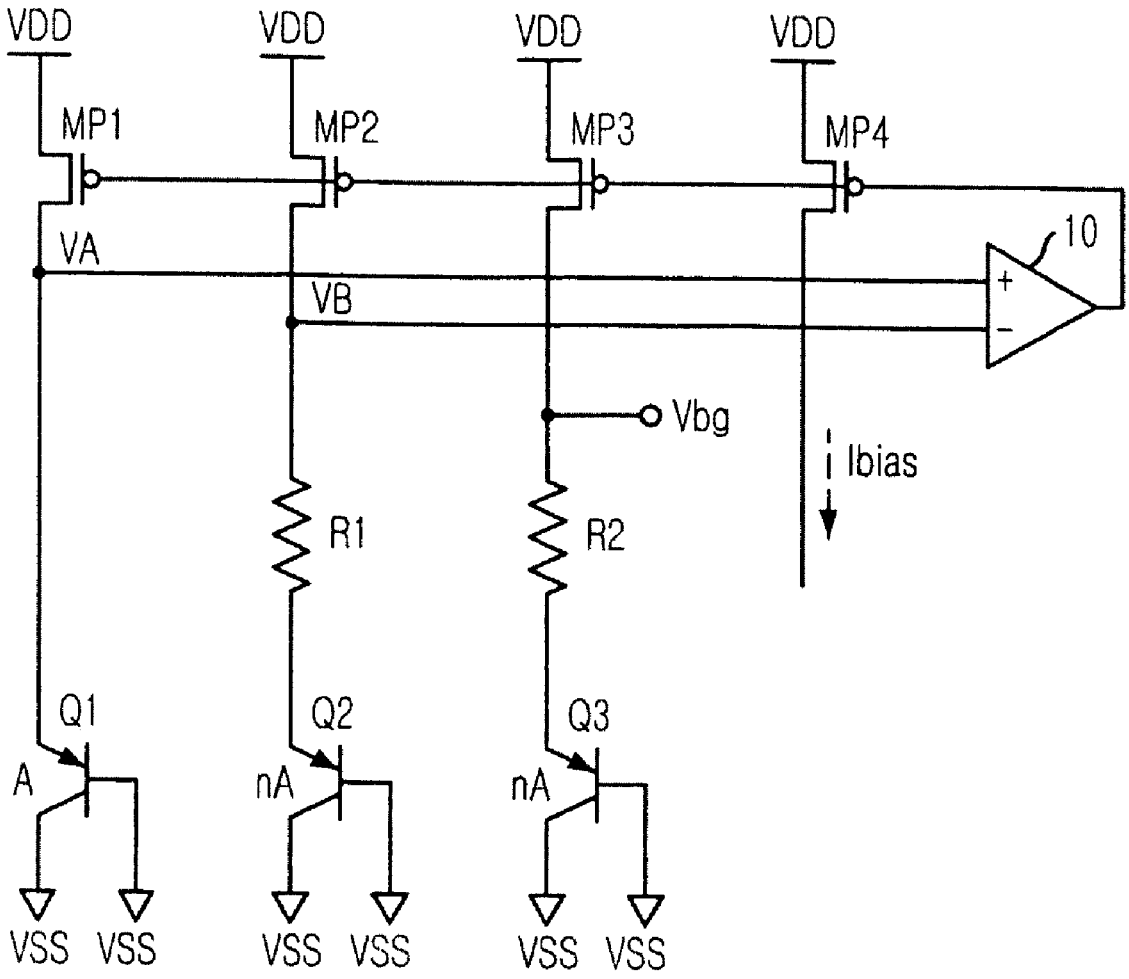
FIG. 2 (PRIOR ART)
FIG. 2 is a circuit diagram showing a conventional band-gap reference voltage generator.
Figure 3:
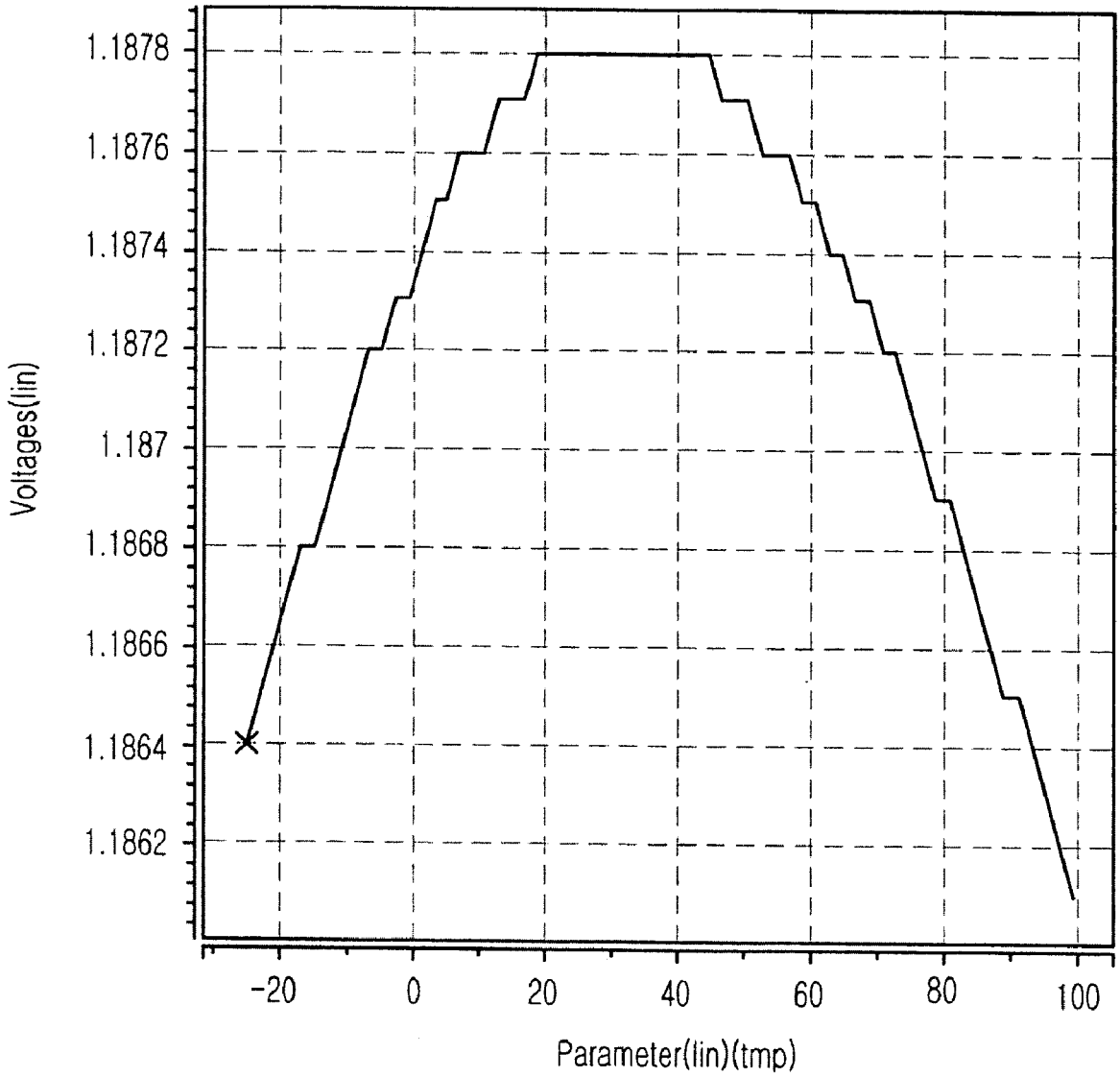
FIG. 3 (PRIOR ART)
FIG. 3 is a waveform diagram showing variation of a reference voltage due to temperature variation in a conventional reference voltage generator shown in FIG. 2.
Figure 4:
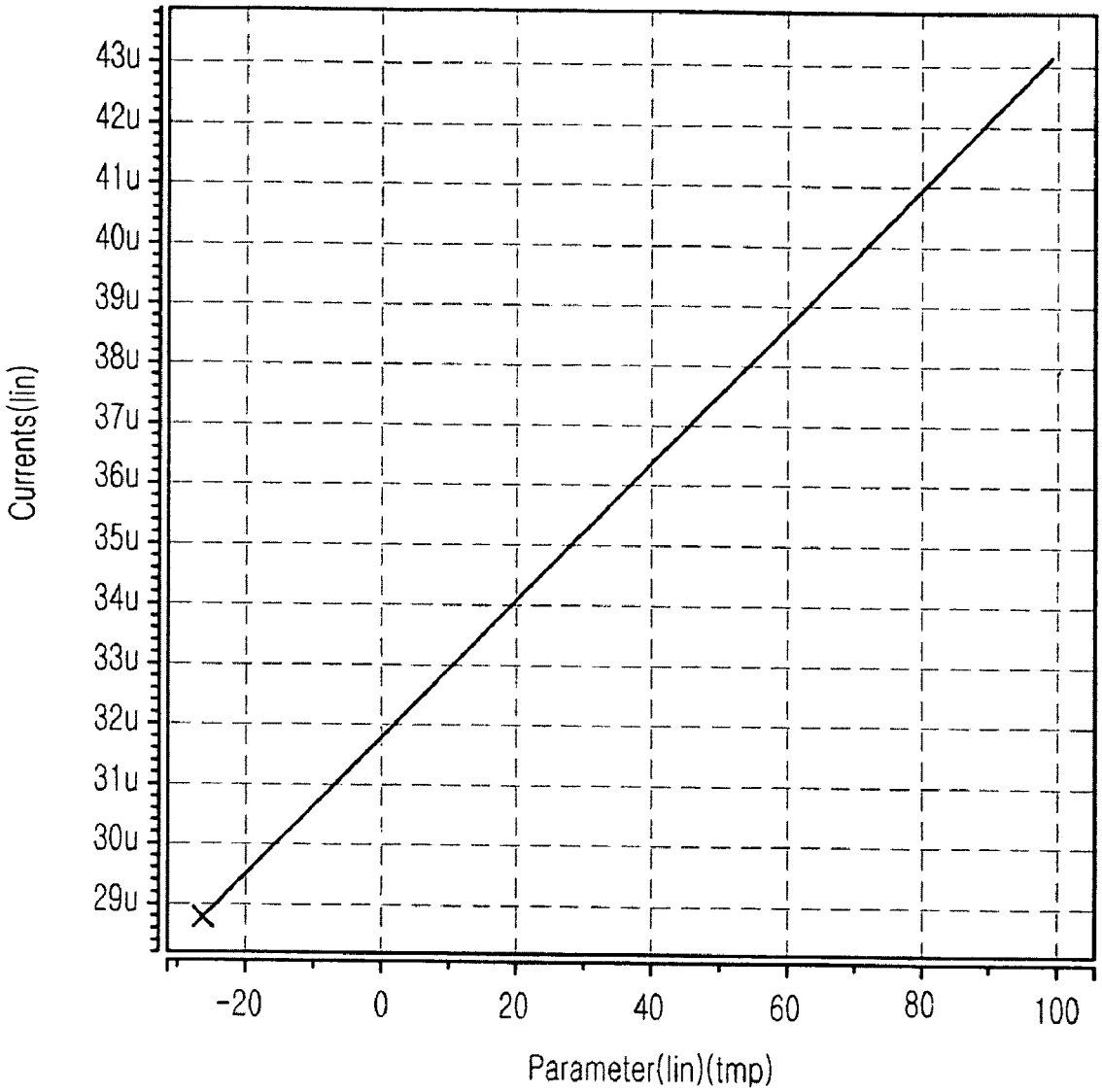
FIG. 4 (PRIOR ART)
FIG. 4 is a waveform diagram showing variation of a reference current due to temperature variation in a conventional reference voltage generator shown in FIG. 2.
Figure 5:
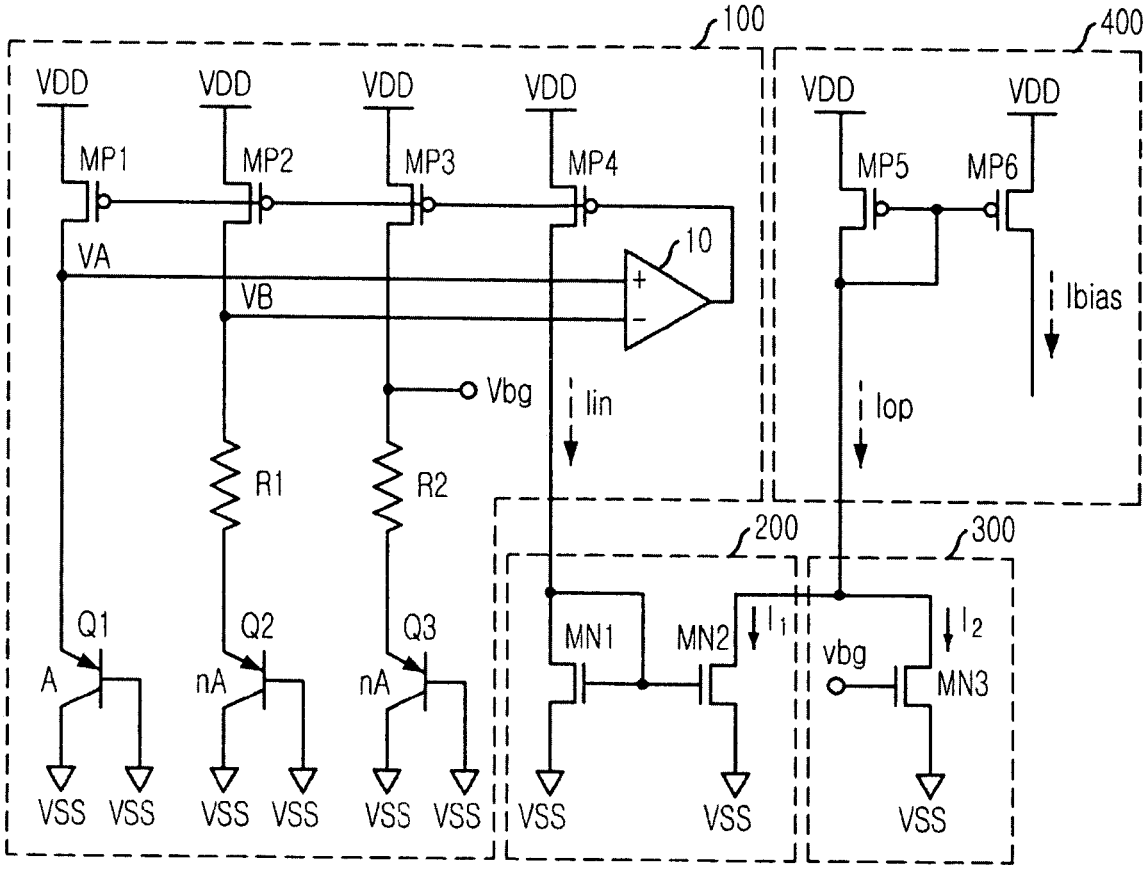
FIG. 5 is a circuit diagram showing a reference current and reference voltage generator in accordance with a preferred embodiment of the present invention.

FIG. 5 is a circuit diagram showing a reference current and reference voltage generator in accordance with a preferred embodiment of the present invention.

Referring to FIG. 5, the reference voltage and reference current generator according to the preferred embodiment of the present invention comprises a reference voltage generating unit 100 for outputting a reference voltage Vbg having a stable level regardless of temperature variation and process variation by using junction voltage Vbe3 characteristic and thermal voltage $V_T$ characteristic of bipolar transistors, and supplying an inner current Iin corresponding to the thermal voltage $V_T$ characteristic; a first current mirror 200 for mirroring the inner current Iin to supply a first current I1; a temperature compensation MOS transistor 300 having a source-drain stage through which a second current I2 corresponding to the reference voltage Vbg is supplied; and a second current mirror 400 for supplying a reference current Ibias corresponding to the first current I1 and the second current I2.

Further, the first current mirror 200 includes a MOS transistor MN1 diode-coupled for receiving the inner current Iin at one end, and a MOS transistor MN2 having a gate coupled commonly to the gate of the first MOS transistor MN1 for mirroring the inner current Iin to supply the first current I1.

The second current mirror 400 includes a MOS transistor MP5 for providing an operation current Iop corresponding to the sum of the first current I1 and the second current I2 to supply the second MOS transistor MN2 through the source-drain stage with the first current I1 and the temperature compensation MOS transistor 300 with the second current I2, respectively; and a MOS transistor MP6 having a gate coupled commonly to the gate of the MOS transistor MP5 for mirroring the operation current Iop to supply the reference current Ibias.

Further, the reference voltage generating unit 100 includes bipolar transistors Q1, Q2, Q3, each being diode-coupled; a resistor R1 having one end coupled to the emitter of the bipolar transistor Q2; a resistor R2 having one end coupled to the emitter of the bipolar transistor Q3; an operational amplifier 110 having a positive input (+) coupled to the emitter of the bipolar transistor Q1 and a negative input (−) coupled to the other end of the resistor R1; PMOS transistors MP1, MP2, MP3 having gates receiving the output of the operational amplifier 110, one ends commonly coupled to a power supply voltage VDD and the other ends coupled to the emitter VA of the bipolar transistor Q1, the other end of the resistor R1 and the other end of the resistor R2, respectively; and a PMOS transistor MP4 having a gate receiving the output of the operational amplifier 110, one end coupled to the power supply voltage VDD, and other end supplying the inner current Iin.

Figure 6:
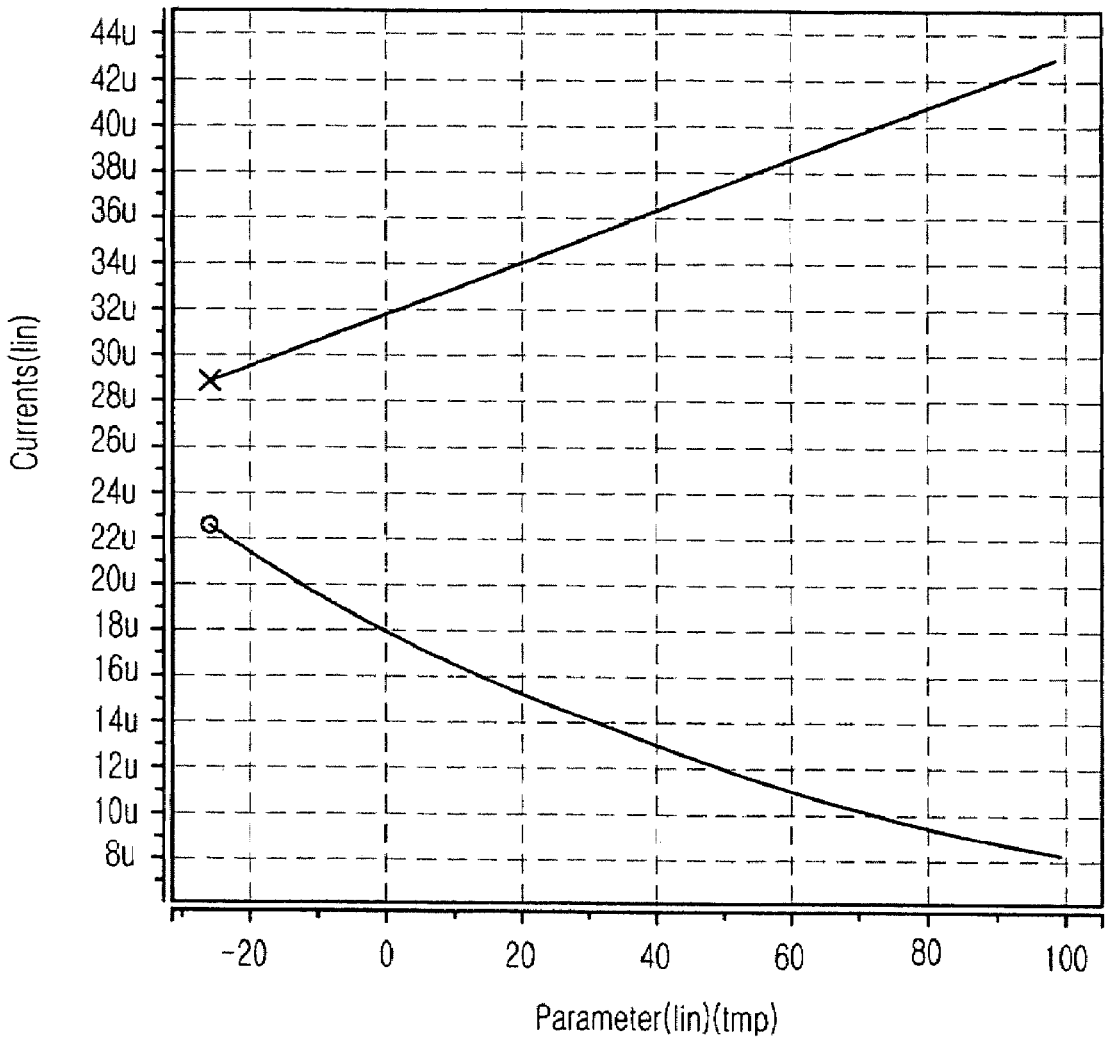
FIG. 6 is a waveform diagram showing variation of a first reference current and a second reference current due to temperature variation in a reference voltage and reference voltage generator shown in FIG. 5.
Figure 7:
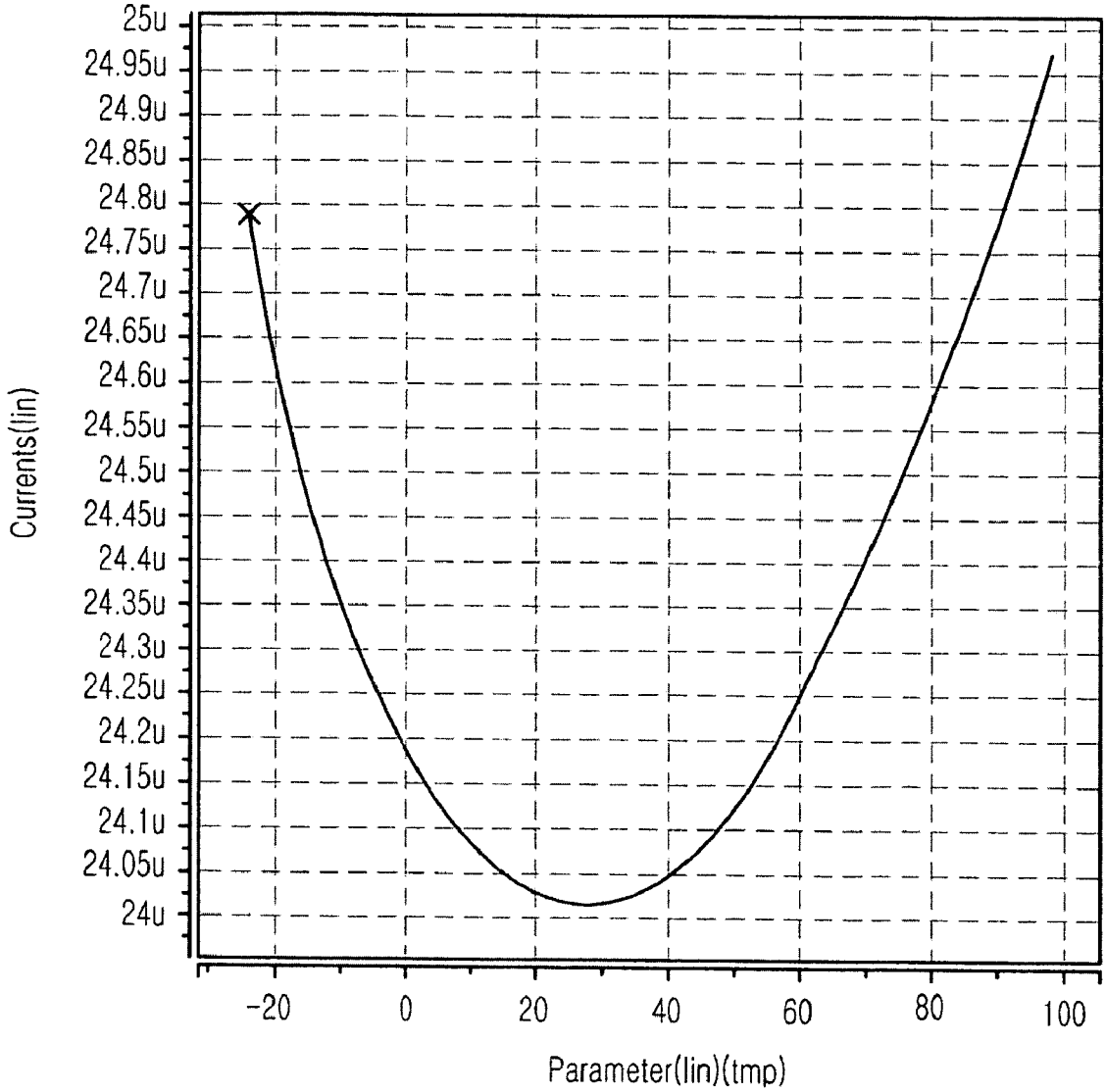
FIG. 7 is a waveform diagram showing variation of a reference current due to temperature variation in a reference voltage and reference voltage generator shown in FIG. 5.

FIG. 6 is a waveform diagram showing variation of a first reference current and a second reference current due to temperature variation in a reference voltage and reference voltage generator shown in FIG. 5. FIG. 7 is a waveform diagram showing variation of a reference current due to temperature variation in a reference voltage and reference voltage generator shown in FIG. 5.

It will be described for the operation of the reference voltage and reference current generator according to the preferred embodiment of the present invention with reference to FIG. 5 to FIG. 7.

The reference voltage generator unit 100 outputs the reference voltage Vbg having the stable level regardless of temperature variation and process variation by using the junction voltage Vbe3 characteristic and the thermal voltage $V_T$ characteristic of the bipolar transistors, and supplies the inner current Iin (see Eq. 2) corresponding to the thermal voltage $V_T$ characteristic.

Then, the first current mirror 200 provides the first current I1 for which the inner current Iin is mirrored. Here, the first current I1 is directly proportional to temperature variation.

On the other hand, the temperature compensation MOS transistor receives the reference voltage Vbg through its gate to make the second current I2 that is inversely proportional to temperature variation flow through its source-drain stage.

The diode-coupled MOS transistor MP5 of the second current mirror 300 supplies the MOS transistor MN2 and the MOS transistor 300 with the first current I1 and the second current I2, respectively. Here, the operation current Iop through the MOS transistor MP5 corresponds to the sum of the first current I1 and the second current I2.

Finally, the MOS transistor MP6 of the second current mirror 300 mirrors the operation current Iop to supply the reference current Ibias.

The reference voltage Vbg that is outputted from the reference voltage and reference current generator of the present embodiment maintains its voltage level as described in Eq. 1 in the conventional technique while the reference current Ibias maintains its current level as follows.

$$\text{Ibias}=Iop(MP5)=(V_T\times ln\ n)/R1+\tfrac{1}{2}\times{}_n\times C_{ox}\times W/L\times(Vbg-Vtn)^2 \qquad \text{Eq. 3}$$

In Eq. 3, the first term means the first current I1 through the drain-source of the MOS transistor MN2 and the second term means the second current I2 through the drain-source of the temperature compensation MOS transistor 300. Accordingly, Vtn and W/L in the second term represent the threshold voltage and the width and the length of the MOS transistor 300.

As described above, $V_T$ in the first term increases by 0.085 mV/° C. depending on temperature variation while the mobility $_n$ in the second term has negative characteristic on temperature variation because of its $T^{-1.5}$ characteristic on temperature.

Referring to FIG. 6, the first current that may be represented as the first term in Eq. 3 increases depending on temperature variation while the second current that may be represented as the second term in Eq. 3 decreases depending on temperature variation.

Continuously referring to FIG. 7, the reference current Ibias corresponding to the sum of the first current I1 and the second current I2 shows change of just 0.8 A from 24 to 24.8 A when temperature increases from −20° C. to 100° C.

As seen, the reference voltage and reference current generator of the present embodiment maintains the stable reference voltage and the stable reference current without regard to temperature variation. Accordingly, any analog system using those reference voltage and reference current may operate reliably regardless of temperature variation.

According to the present invention, it is possible to supply a reference voltage and a reference current, both having a stable level, in an integrated circuit without regard to temperature variation.

When the reference voltage and reference current generator of the present invention is applied to an analog system that requires both of the reference voltage and the reference current, the analog system may use the stable reference voltage and the stable reference current regardless of temperature variation so as to make it possible to implement a very reliable analog system.

The present application contains subject matter related to the Korean patent application No. KR 2004-31946, filled in the Korean Patent Office on May 6, 2004, the entire contents of which being incorporated herein by reference.

While the present invention has been described with respect to the particular embodiments, it will be apparent to those skilled in the art that various changes and modifications may be made without departing from the spirit and scope of the invention as defined in the following claims.

What is claimed is:

1. A reference voltage and reference current generator comprising:

a reference voltage generating means for outputting a reference voltage having a stable level regardless of temperature variation and process variation by using junction voltage characteristic and thermal voltage characteristic of bipolar transistors, and supplying an inner current corresponding to the thermal voltage characteristic;

a first current mirror for mirroring the inner current to supply a first current;

a temperature compensation MOS transistor for supplying a second current corresponding to the reference voltage through a source-drain stage; and a second current mirror for supplying a reference current corresponding to the first current and the second current.

2. The reference voltage and reference current generator as recited in claim 1, wherein the first current mirror includes:

a first MOS transistor diode-coupled for receiving the inner current at one end; and a second MOS transistor having a gate coupled commonly to the gate of the first MOS transistor for mirroring the inner current to supply the first current.

3. The reference voltage and reference current generator as recited in claim 2, wherein the second current mirror includes:

a third MOS transistor diode-coupled for providing an operation current corresponding to the sum of the first current and the second current to supply the second MOS transistor and the temperature compensation MOS transistor with the first current and the second current, respectively, through a source-drain stage; and a fourth MOS transistor having a gate coupled commonly to the gate of the third MOS transistor for mirroring the operation current to supply the reference current.

4. The reference voltage and reference current generator as recited in claim 1, wherein the reference voltage generating means includes:

a first to a third bipolar transistors, each being diode-coupled;

a second resistor having one end coupled to the emitter of the second bipolar transistor;

a third resistor having one end coupled to the emitter of the third bipolar transistor;

an operational amplifier having a positive input coupled to the emitter of the first bipolar transistor and a negative input coupled to the other end of the first resistor;

a first to a third PMOS transistors having gates receiving the output of the operational amplifier, one ends commonly coupled to a power supply voltage and the other ends coupled to the emitter of the first bipolar transistor, the other end of the first resistor and the other end of the second resistor, respectively; and a fourth PMOS transistor having a gate receiving the output of the operational amplifier, one end coupled to the power supply voltage, and other end for supplying the inner current.

* * * * *